US007486022B2

(12) United States Patent
Kang et al.

(10) Patent No.: US 7,486,022 B2
(45) **Date of Patent: *Feb. 3, 2009**

(54) PLASMA DISPLAY PANEL (PDP)

(75) Inventors: Kyoung-Doo Kang, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 684 days.

This patent is subject to a terminal disclaimer.

(21) Appl. No.: 11/117,576

(22) Filed: Apr. 29, 2005

(65) Prior Publication Data

US 2005/0258748 A1 Nov. 24, 2005

(30) Foreign Application Priority Data

May 18, 2004 (KR) ..... 10-2004-0035068

(51) Int. Cl.
*H01J 17/49* (2006.01)

(52) U.S. Cl. ..... 313/582; 313/583

(58) Field of Classification Search ..... None
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,744,909 A * 4/1998 Amano ..... 313/585
5,786,794 A 7/1998 Kishi et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Ashok Patel
(74) *Attorney, Agent, or Firm*—Robert E. Bushnell, Esq.

(57) ABSTRACT

A Plasma Display Panel (PDP) includes: a first substrate; a second substrate facing the first substrate; first barrier ribs, formed of a dielectric material and arranged between the first and second substrates, the first barrier ribs defining discharge cells with the first and second substrates; a phosphor layer arranged in the discharge cells; upper discharge electrodes arranged in the first barrier ribs and extending to surround the discharge cells; and lower discharge electrodes arranged in the first barrier ribs to be separated from the upper discharge electrodes, and extending to surround the discharge cells; wherein at least one of the upper and lower discharge electrodes includes discharge units that are respectively divided into plural pieces separated from each other to surround the discharge cells, and connection units electrically connecting the discharge units that respectively surround the neighboring discharge cells.

11 Claims, 6 Drawing Sheets

U.S. PATENT DOCUMENTS

| | | | | |
|---|---|---|---|---|
| 5,808,413 | A * | 9/1998 | Bongaerts et al. | 313/585 |
| 5,952,782 | A | 9/1999 | Nanto | |
| 6,060,827 | A * | 5/2000 | Kichimi et al. | 313/582 |
| RE37,444 | E | 11/2001 | Kanazawa | |
| 6,339,292 | B1 * | 1/2002 | Ha | 313/582 |
| 6,630,916 | B1 | 10/2003 | Shinoda | |
| 6,707,436 | B2 | 3/2004 | Setoguchi et al. | |
| 7,067,978 | B2 | 6/2006 | Kwon et al. | |
| 7,196,470 | B2 | 3/2007 | Yoo et al. | |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2005-322636 | 11/2005 |

OTHER PUBLICATIONS

*Office Action* from the Japanese Patent Office issued in Applicant's corresponding Japanese Patent Application No. 2005-117067 dated Feb. 26, 2008.

* cited by examiner

PLASMA DISPLAY PANEL (PDP)

CLAIM OF PRIORITY

This application makes reference to, incorporates herein, and claims all benefits accruing under 35 U.S.C. §119 from an application for PLASMA DISPLAY PANEL earlier filed in the Korean Intellectual Property Office on 18 May 2004 and there duly assigned Serial No. 10-2004-0035068.

BACKGROUND OF THE INVENTION

1. Field of the Invention

The present invention relates to a Plasma Display Panel (PDP) displaying an image using a gas discharge operation.

2. Description of the Related Art

A device adopting a PDP has advantages such as a large screen, high image quality, ultra-thin type, light weight, and wide viewing angle, and is fabricated in simple way and can be enlarged easily. Thus, the PDP can be a next generation flat panel display device.

The PDP can be classified into Direct Current (DC) PDP, Alternating Current (AC) PDP, and hybrid PDP according to a discharge voltage supplied thereto. In addition, the PDP also can be classified into opposing discharge type and surface discharge type according to a discharge structure. An AC PDP having a three-electrode and surface discharge structure is generally used today.

An AC three-electrode surface discharge PDP includes a first substrate and a second substrate facing the first substrate.

Common electrodes and scan electrodes forming discharge gaps with the common electrodes are respectively formed on a lower surface of the first substrate. The common and scan electrodes are covered by a first dielectric layer. A protective layer is formed on a lower surface of the first dielectric layer.

In addition, address electrodes are formed on an upper surface of the second substrate so as to cross the common and scan electrodes. The address electrodes are covered by a second dielectric layer. Barrier ribs are formed on an upper surface of the second dielectric layer and are separated from each other to define discharge spaces. Phosphor layers are formed in the discharge spaces, and a discharge gas fills the discharge spaces.

In the PDP having the above structure, a plasma generated by a discharge emits ultraviolet light in the discharge space. The ultraviolet light excites the phosphor layer, and the excited phosphor layer emits visible light to display an image.

However, since the electrodes, the first dielectric layer, and the protective layer are sequentially formed on the lower portion of the first substrate, about 40% of the visible light emitted by the phosphor layer is absorbed by the layers, thus reducing the light emission efficiency. Moreover, when the same image is displayed for a long time, charged particles of the discharge gas are ion-sputtered onto the phosphor layer by the electric field, thereby causing a permanent residual image and reducing the PDP lifespan.

SUMMARY OF THE INVENTION

The present invention provides a PDP that has improved brightness and light emission efficiency, and can be driven with a low voltage and a low current.

According to one aspect of the present invention, a Plasma Display Panel (PDP) is provided including: a first substrate; a second substrate facing the first substrate; first barrier ribs, formed of a dielectric material and arranged between the first and second substrates, the first barrier ribs defining discharge cells with the first and second substrates; a phosphor layer arranged in the discharge cells; upper discharge electrodes arranged in the first barrier ribs and extending to surround the discharge cells; and lower discharge electrodes arranged in the first barrier ribs to be separated from the upper discharge electrodes, and extending to surround the discharge cells; wherein at least one of the upper and lower discharge electrodes includes discharge units that are respectively divided into plural pieces separated from each other to surround the discharge cells, and connection units electrically connecting the discharge units that respectively surround the neighboring discharge cells.

The discharge units are preferably arranged in a row, and each of the discharge units preferably includes first and second discharge units facing each other and separated from each other, and preferably arranged along the discharge units, and third and fourth discharge units preferably arranged between the first and second discharge units to be separated from them.

The first and second discharge units are preferably continuously connected to the first and second discharge units of an adjacent discharge cell via first and second connection units; the third discharge unit is preferably continuously connected to the second discharge unit of an adjacent discharge cell via a third connection unit; and the fourth discharge unit is preferably continuously connected to the first discharge unit of an adjacent discharge cell via a fourth connection unit.

The first barrier ribs preferably define discharge cells of a closed type, and the first and second discharge units preferably respectively have bent end portions that exceed ¼ point of a boundary of the discharge cell and surround the discharge cell.

The third and fourth connection units are preferably arranged parallel to the direction of the discharge units.

The third and fourth connection units are preferably inclined a predetermined angle with respect to the direction of the discharge units.

The upper discharge electrodes preferably extend perpendicularly to the extending direction of the upper discharge electrodes.

The upper and lower discharge electrodes preferably extend parallel to each other, and address electrodes that extend perpendicularly to the extending direction of the upper and lower discharge electrodes are preferably arranged in the discharge cells.

The address electrodes are preferably arranged in a dielectric layer arranged between the second substrate and the phosphor layer.

Second barrier ribs are preferably further arranged between the first barrier ribs and the second substrate to define discharge cells with the first barrier ribs, and the phosphor layer is preferably arranged in the spaces defined by the second barrier ribs.

An MgO layer preferably covers side surfaces of the first barrier ribs.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
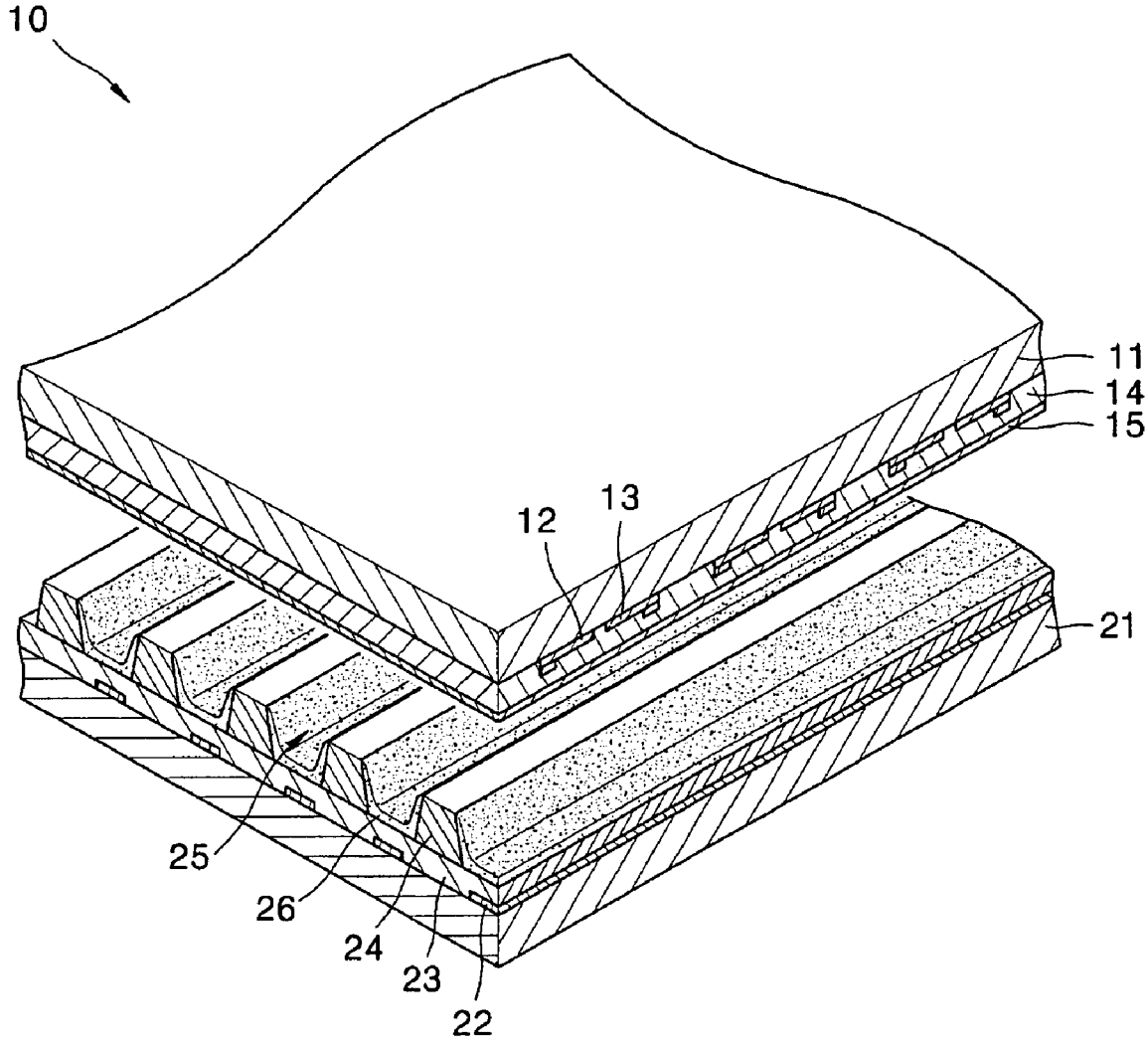
FIG. 1 is a partial perspective view of a PDP.

FIG. 1 is a view of an AC three-electrode surface discharge PDP.

The PDP 10 includes a first substrate 11 and a second substrate 21 facing the first substrate 11.

Common electrodes 12 and scan electrodes 13 forming discharge gaps with the common electrodes 12 are respectively formed on a lower surface of the first substrate 11. The common and scan electrodes 12 and 13 are covered by a first dielectric layer 14. A protective layer 15 is formed on a lower surface of the first dielectric layer 14.

In addition, address electrodes 22 are formed on an upper surface of the second substrate 21 so as to cross the common and scan electrodes 12 and 13. The address electrodes 22 are covered by a second dielectric layer 23. Barrier ribs 24 are formed on an upper surface of the second dielectric layer 23 and are separated from each other to define discharge spaces 25. Phosphor layers 26 are formed in the discharge spaces 25, and a discharge gas fills the discharge spaces 25.

In the PDP 10 having the above structure, a plasma generated by a discharge emits ultraviolet light in the discharge space 25. The ultraviolet light excites the phosphor layer 26, and the excited phosphor layer 26 emits visible light to display an image.

However, since the electrodes 12 and 13, the first dielectric layer 14, and the protective layer 15 are sequentially formed on the lower portion of the first substrate 11, about 40% of the visible light emitted by the phosphor layer 26 is absorbed by the layers, thus reducing the light emission efficiency. Moreover, when the same image is displayed for a long time, charged particles of the discharge gas are ion-sputtered onto the phosphor layer 26 by the electric field, thereby causing a permanent residual image and reducing the PDP lifespan.

Figure 2:
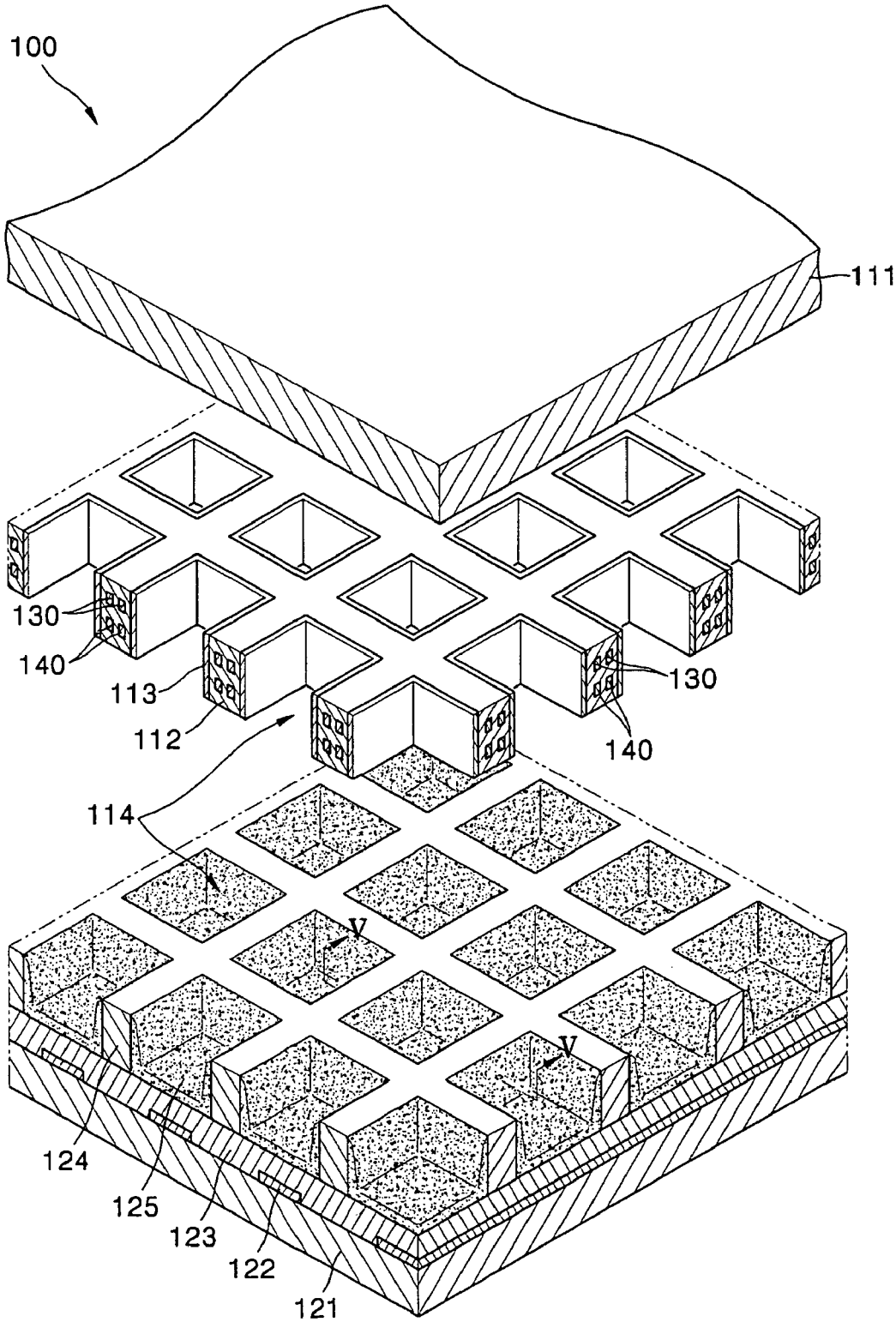
FIG. 2 is a partial perspective view of a PDP according to an embodiment of the present invention.

FIG. 2 is a perspective view of a PDP 100 according to an embodiment of the present invention.

Referring to FIG. 2, the PDP 100 includes a first substrate 111, and a second substrate 121 facing the first substrate 111.

The first and second substrates 111 and 121 are formed of a light-transmittable material, such as a glass, and it is desirable for the first substrate 111 to have a superior light-transmittance when an image is displayed through the first substrate 111.

In addition, first barrier ribs 112 and second barrier ribs 124 are formed in predetermined patterns between the first and second substrates 111 and 121. That is, the first barrier ribs 112 and the second barrier ribs 124 are formed as a closed matrix having a square horizontal cross-section. In addition, lower surfaces of the first barrier ribs 112 correspond to upper surfaces of the second barrier ribs 124. Thus, spaces defined by the first barrier ribs 112 and spaces defined by the second barrier ribs 124 correspond to each other.

However, the first and second barrier ribs can be formed as closed barrier ribs in waffle or delta shapes, or the horizontal cross-section of a barrier rib can be formed as a polygon, such as a triangle or a pentagon, a circular shape, or an oval shape with closed edges. Furthermore, a combination of various types of ribs can be formed, for example, the first barrier rib can be a closed rib, and the second barrier rib can be an open rib, such as stripe.

The first and second barrier ribs 112 and 124 define discharge cells 114, with the first and second substrates 111 and 121, corresponding to a sub-pixel among red, green, and blue color sub-pixels that constitute a unit pixel for realizing colors, and prevent cross-talk from occurring between the defined discharge cells 114. The first barrier rib 112 and the second barrier rib 124 can be formed separately, or can be formed integrally using the same material.

In addition, address electrodes 122 are formed on the upper surface of the second substrate 121 arranged under the second barrier rib 124. The address electrodes 122 are covered by a dielectric layer 123. The address electrodes 122 respectively correspond to the discharge cells 114 so that the discharge cell 114 which will start the discharge can be selected. Although the address electrodes 122 are formed as stripes, the structure of the address electrodes 122 is not limited thereto.

A phosphor layer 125 that is excited by ultraviolet light generated during a sustain discharge to emit visible light is arranged in the discharge cell 114. Referring to FIG. 2, the phosphor layer 125 is formed on the space defined by the second barrier ribs 124, that is, on upper surface of the second substrate 121 and sides of the second barrier ribs 124.

The phosphor layer 125 includes a fluorescent material that is excited by the ultraviolet light that is generated during the discharge and emits red, green, and blue visible light. For example, the phosphor layer formed on the discharge cell corresponding to the red color sub-pixel includes a fluorescent material such as $Y(V,P)O_4$:Eu, the phosphor layer formed in the discharge cell corresponding to the green color sub-pixel includes a fluorescent material such as $Zn_2SiO_4$:Mn and $YBO_3$:Tb, and the phosphor layer formed in the discharge cell corresponding to the blue color sub-pixel includes the fluorescent material such as BAM:Eu.

Since the phosphor layer 125 is formed on the space defined by the second barrier ribs 124, it is noticeably separated from the space of the first barrier rib 112, where the sustain discharge occurs. Therefore, the ion-sputtering of the phosphor layer 125 by the charged particles can be prevented, and the generation of a permanent residual image can be greatly reduced even when the same image is displayed for a long time.

The discharge gas fills the discharge cells 114, in which the phosphor layer 125 is arranged, and the discharge gas can be a mixed gas including Xe to generate ultraviolet light and Ne functioning as a buffer.

Upper discharge electrodes 130 and lower discharge electrodes 140 are formed in the first barrier ribs 112 to define the discharge cells 114 with the second barrier ribs 124, and to generate a discharge in the discharge cells 114. The upper discharge electrodes 130 are arranged at an upper portion adjacent to the first substrate 111, and the lower discharge electrodes 140 are arranged under the upper discharge electrodes 130. The upper and lower discharge electrodes 130 and 140 can be formed of a conductive metal such as aluminum, copper, and silver. Since a metal electrode has a lower resistance than that of an electrode formed of Indium Tin Oxide (ITO), the discharge response speed can be faster than that of a conventional panel.

The first barrier ribs 112 are formed of a dielectric material, such as PbO, $B_2O_3$, and $SiO_2$. Accordingly, a direct electrical conduct between the upper and lower discharge electrodes 130 and 140 is prevented; the charged particles do not directly collide with the upper and lower discharge electrodes 130 and 140 during the discharge; and the charged particles are induced for easily accumulating wall charges.

In addition, an MgO layer 113 of a predetermined thickness is further formed on the sides of each first barrier rib 112. When the MgO layer 113 is formed, the direct collision of the charged particles generated during the discharge with the first barrier ribs 112 can be prevented, and the damage to the first barrier ribs 112 caused by ion-sputtering of the charged particles can be prevented. Moreover, since the charged particles directly collide with the MgO layer 113, the MgO layer 113 can emit secondary electrons that contribute to the discharge. Therefore, the panel 100 can be driven with a low voltage and the light emission efficiency can be improved.

Figure 3:
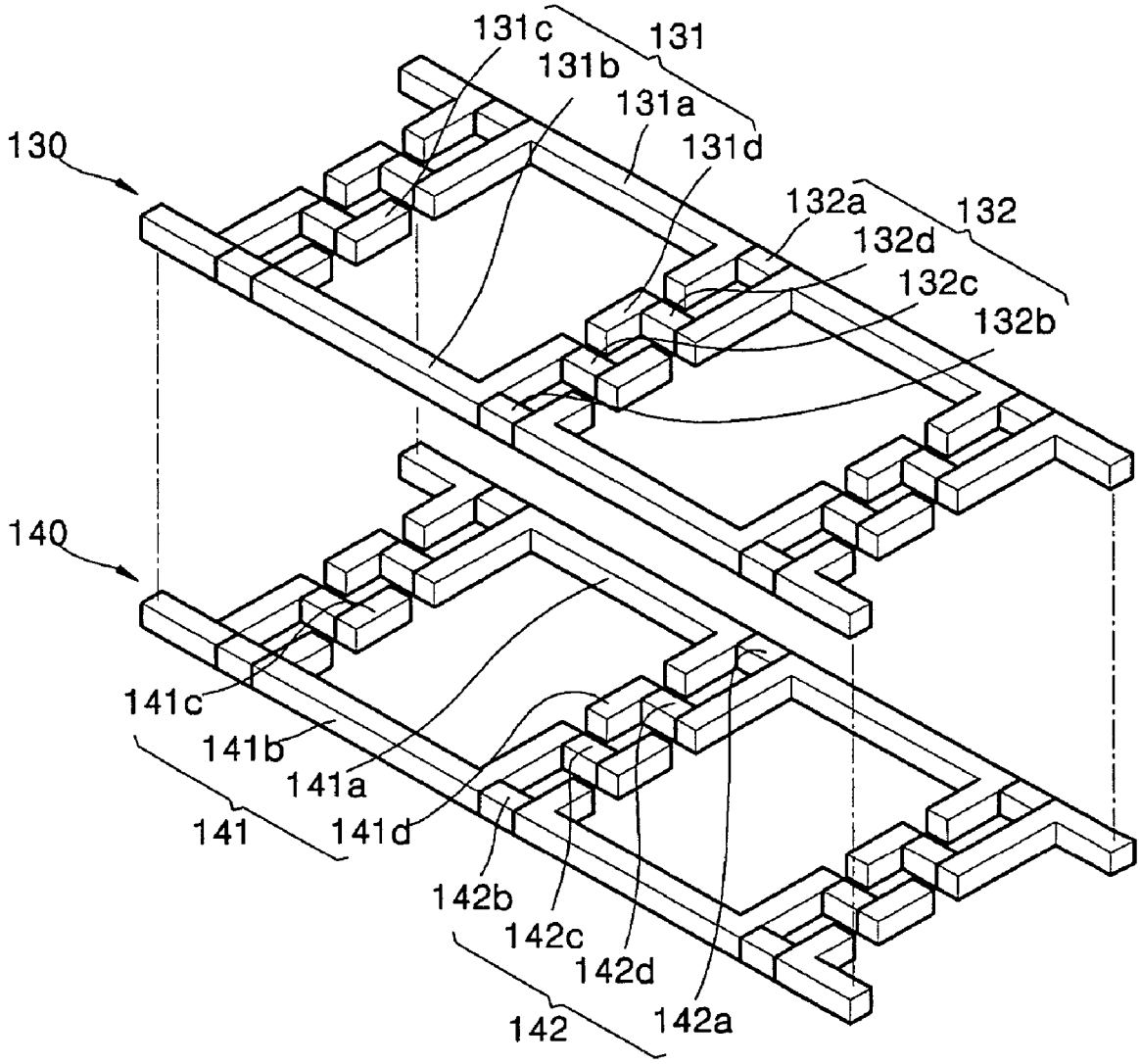
FIG. 3 is a perspective view of an upper discharge electrode and a lower discharge electrode of FIG. 2.
Figure 4:
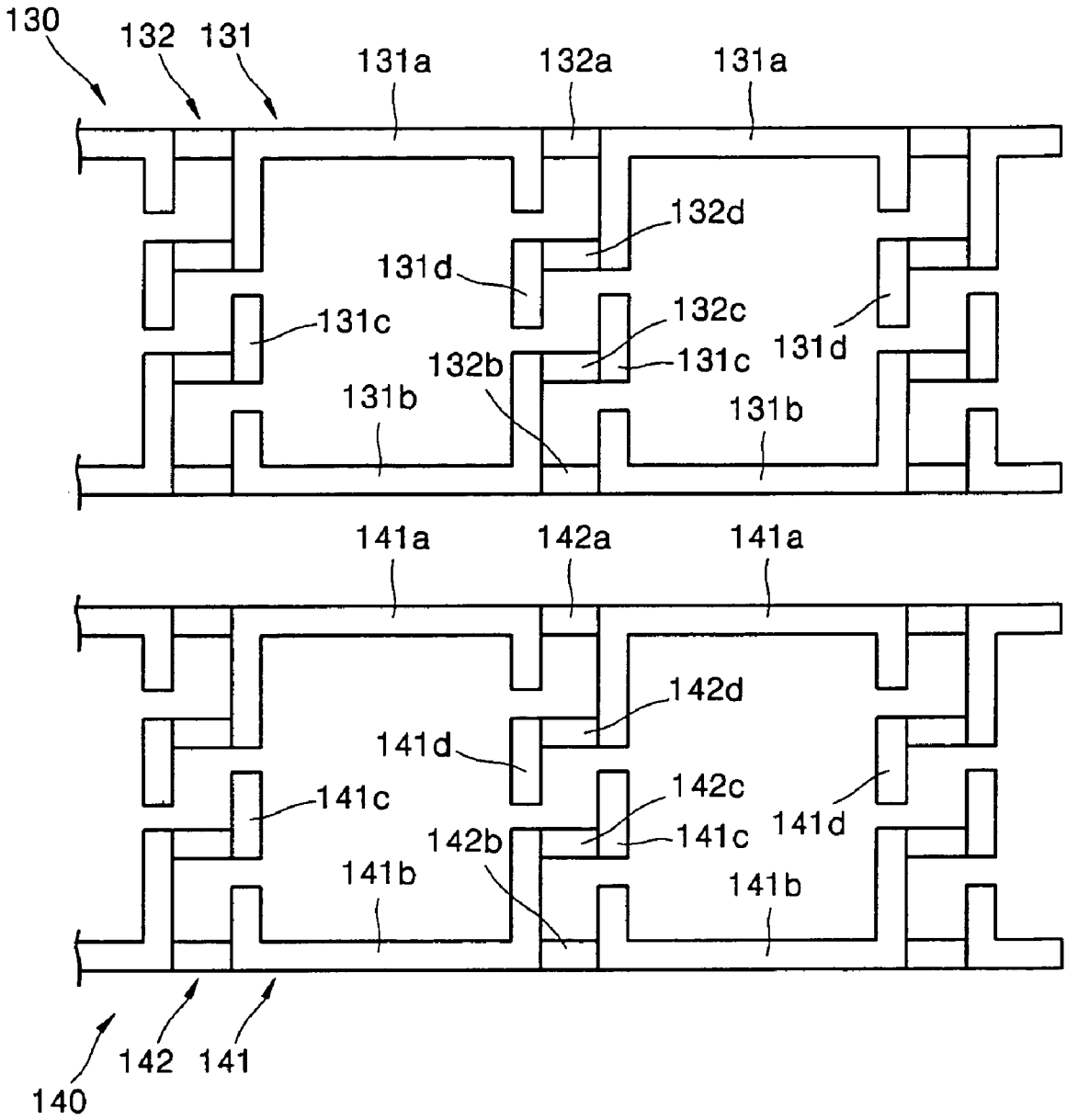
FIG. 4 is a plan view of the upper and lower discharge electrodes of FIG. 3.

The upper and lower discharge electrodes 130 and 140 arranged in the first barrier ribs 112 are described below in more detail with reference to FIGS. 3 and 4.

The upper discharge electrodes 130 arranged on the upper portion of the first barrier ribs 112 are separated by predetermined distances from each other, and extend along a predetermined direction. Referring to the drawings, one upper discharge electrode 130 can surround four sides of each discharge cell 114 arranged in a predetermined direction. That is, each upper discharge electrode 130 includes discharge units 131 that are arranged in the first barrier rib 112 and surrounds the discharge cells 114 to contribute to the discharge.

The discharge units 131 are formed as square bands, each of which has a predetermined width and is divided into a plural pieces that are separated from each other. In addition, some of the discharge units 131 are connected to other discharge units 131 which surround the neighboring discharge cells 114 via connection units 132 arranged in a predetermined pattern. Thus, the voltage supplied from an end of the upper discharge electrode 130 is transmitted to all of the discharge units 131.

Each of the discharge units 131 includes first and second discharge units 131*a* and 131*b* that face each other at a predetermined distance apart and are arranged along the arrangement of the discharge units 131, and third and fourth discharge units 131*c* and 131*d* that are arranged between the first and second discharge units 131*a* and 131*b* and are separated from the first and second discharge units 131*a* and 131*b*. Accordingly, gaps are formed between the first discharge unit 131*a* and the third and fourth discharge units 131*c* and 131*d*, and between the second discharge unit 131*b* and the third and fourth discharge units 131*c* and 131*d*. End portions of the first and second discharge units 131*a* and 131*b* are bent to exceed ¼ point of the discharge cell 114 and surround the discharge cell 114. However, the third and fourth discharge units 131*c* and 131*d* are shorter than the first and second discharge units 131*a* and 131*b*.

One discharge unit 131*a* is connected to the first discharge unit 131*a* of adjacent discharge cell 114 via a first connection unit 132*a*, and the second discharge unit 131*b* is connected to the second discharge unit 131*b* of an adjacent discharge cell 114 via a second connection unit 132*b*. In addition, the third discharge unit 131*c* is connected to the second discharge unit 131*b* of an adjacent discharge cell 114 via a third connection unit 132*c*, and the fourth discharge unit 131*d* is connected to the first discharge unit 131*a* of the adjacent discharge cell 114 via a fourth connection unit 132*d*.

The first and second connection units 132*a* and 132*b* are arranged at the bent portions of the first and second discharge units 131*a* and 131*b* parallel to the arranged direction of the discharge units 131. In addition, the third and fourth connection units 132*c* and 132*d* are arranged parallel to the arranged direction of the discharge units 131.

Since the discharge units 131 are electrically connected to each other by the first, second, third, and fourth connection units 132*a*, 132*b*, 132*c*, and 132*d*, one entirely connected upper discharge electrode 131 can be formed. In addition, the connection units are formed to have minimum widths in order to minimize the effects on the discharge, so as not to cause a disconnection. In the drawings, the width of connection unit is the same as that of the discharge unit. However, the present invention is not limited thereto.

Figure 5:
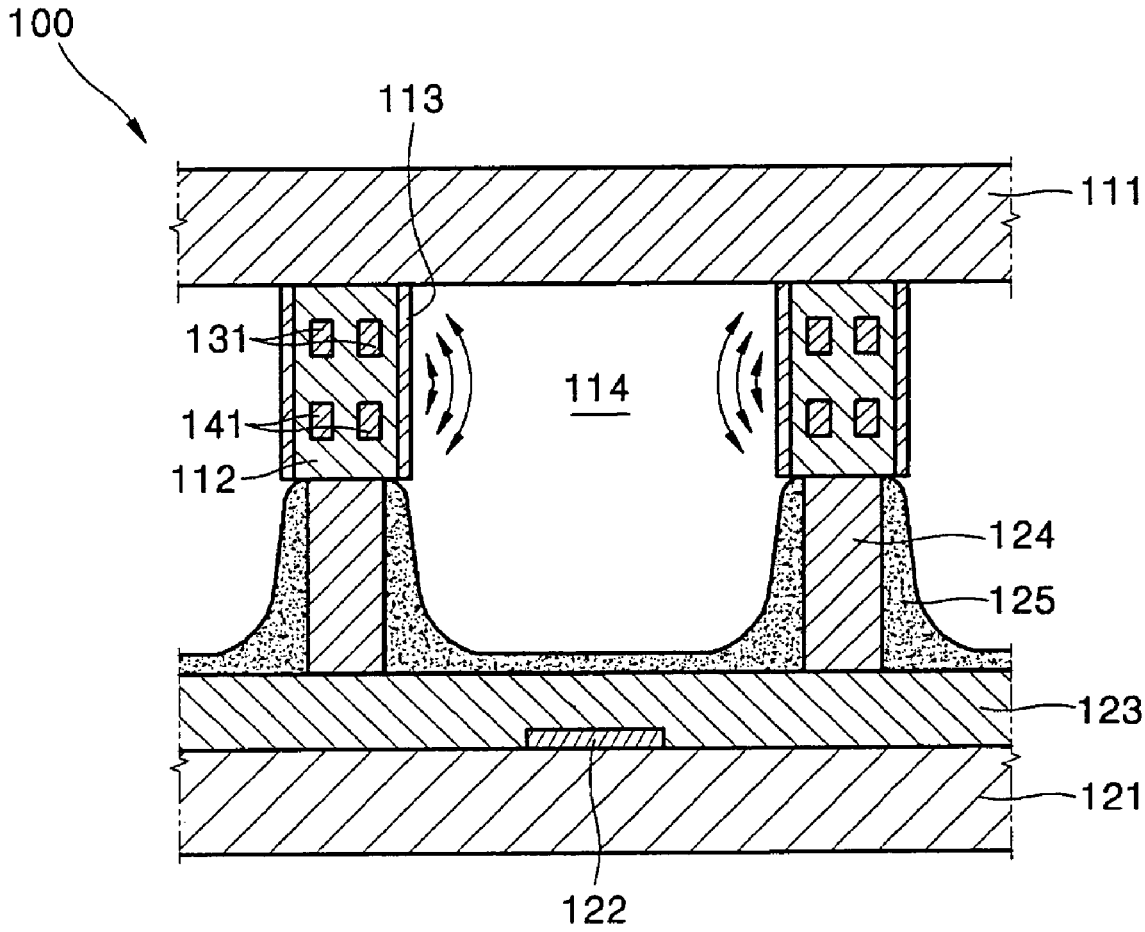
FIG. 5 is a cross-sectional view of the PDP along line V-V of FIG. 2.

The upper discharge electrodes 130 are arranged perpendicularly to the extending direction of the upper discharge electrode 130 with predetermined intervals therebetween. In the discharge units 131 of the upper discharge electrodes 130, portions separated from each other constitute a set and are arranged in one first barrier rib 112 that is formed along the extended direction of the upper discharge electrodes 130 as shown in FIG. 5.

The lower discharge electrodes 140 arranged under the upper discharge electrodes 130 can be formed to have the same structures as those of the upper discharge electrodes 130.

That is, the lower discharge electrodes 140 include discharge units 141 surrounding four sides of the discharge cells 114 that are arranged in a predetermined direction, and connection units 142 connecting the discharge units 141 in predetermined patterns. In addition, each of the discharge units 141 includes first and second discharge units 141*a* and 141*b* arranged along the arranged direction of discharge units 141, and third and fourth discharge units 141*c* and 141*d* arranged between the first and second discharge units 141*a* and 141*b* so as to be separated from the first and second discharge units 141*a* and 141*b*, as shown in FIGS. 3 and 4. Accordingly, gaps are formed between the first discharge unit 141*a* and the third and fourth discharge units 141*c* and 141*d* respectively, and gaps are also formed between the second discharge unit 141*b* and the third and fourth discharge units 141*c* and 141*d* respectively.

In addition, both ends of the first and second discharge units 141*a* and 141*b* are bent to exceed ¼ of the entire boundary of discharge cell 114 of the closed type and surround the discharge cell 114, and the third and fourth discharge units 141*c* and 141*d* are shorter than the first and second discharge units 141*a* and 141*b*. Some of the first and second discharge units 141*a* and 141*b* are connected to the first and second discharge units 141*a* and 141*b* of the adjacent discharge cell 114 respectively via first and second connection units 142*a* and 142*b*. The third discharge unit 141*c* is connected to the second discharge unit 141*b* of the adjacent discharge cell 114 via a third connection unit 142*c*, and the fourth discharge unit 141*d* is connected to the first discharge unit 141*a* of the adjacent discharge cell 114 via a fourth connection unit 142*d*.

The first and second connection units 142*c* and 142*d* are arranged at the bent portions of the first and second discharge units 141*a* and 141*b* parallel to the arranged direction of the discharge units 141. In addition, the third and fourth connection units 142*c* and 142*d* are arranged parallel to the arranged direction of the discharge units 141.

The lower discharge electrodes 140 having the above structures are arranged perpendicularly to the extending direction of the lower discharge electrode 140 and are separated predetermined distances from each other. The separated portions of the discharge units 141 of the lower discharge electrodes 140 constitute a set as shown in FIG. 5, and are arranged in one first barrier rib 112 that is formed along the extending direction of the lower discharge electrodes 140.

As described above, in the upper and lower discharge electrodes 130 and 140, since the discharge units 131 and 141 are divided into plural pieces respectively and the pieces are separated from each other, some portions of the discharge units 131 and 141 can be omitted. Therefore, the electric currents do not flow in the area where the gaps of the discharge units 131 and 141 exist. Thus, the panel can be driven at a low power.

In addition, it is desirable for the gap in the discharge unit to be set so that the discharge path is not blocked by the gap so that the loss of brightness can be minimized. In addition, in the above description, some portions of the discharge units in both the upper and lower discharge electrodes have been removed. However, one of the upper and lower discharge electrodes can have a continuous structure, that is, no portion of the discharge unit is removed.

One of the upper and lower discharge electrodes 130 and 140 having the above structures corresponds to a common electrode, and the other of the upper and lower discharge electrodes 130 and 140 corresponds to a scan electrode. The charged particles are moved in an up-and-down direction by a sustain voltage that is alternately supplied between the upper and lower discharge electrodes 130 and 140, which generate a sustain discharge.

It is desirable for the lower discharge electrode 140 to acts as the scan electrode since the address voltage supplied between the lower discharge electrode 140 and the address electrode 122 can be lowered and the address discharge can be performed sufficiently.

The address electrode 122 generating the address discharge accumulates the charged particles onto the upper discharge electrode 130 and the lower discharge electrode 140 after completing the address discharge. Thus, the sustain discharge can be performed sufficiently between the upper and lower discharge electrodes 130 and 140. Accordingly, the initial voltage of the sustain discharge can be lowered. In addition, the address electrode 122 can be omitted. However, if the address electrode 122 is omitted, the upper and lower discharge electrodes must be arranged perpendicularly to select the discharge cell and perform the discharge. One of the upper and lower discharge electrodes functions as the address and sustain electrode, and the other of the upper and lower discharge electrodes functions as the scan and sustain electrode.

The operations of the PDP 100 are as follows.

When the address voltage is supplied between the lower discharge electrode 140 functioning as the scan electrode and the address electrode 122, an address discharge occurs. As a result of the address discharge, the discharge cell 114 that will start the sustain discharge is selected. After the address discharge, the sustain voltage is alternately supplied between the upper discharge electrode 130 arranged at the selected discharge cell 114 and the lower discharge electrode 140, and the sustain discharge occurs between the upper and lower discharge electrodes 130 and 140. The sustain discharge is concentrated at the upper portion of the discharge cell 114, and occurs perpendicularly to all sides of the discharge cell 114 gradually toward the center of the discharge cell 114. The discharge gas is excited by the sustain discharge, and the excited discharge gas emits ultraviolet light. The ultraviolet light excites the phosphor layer 125 formed in the discharge cell 114, and the excited phosphor layer 125 emits visible light to display the image.

As described above, the sustain discharge occurs at every side of the discharge cell 114, and accordingly, a volume of the region where the sustain discharge occurs becomes larger than that of the panel of FIG. 1. Thus, space charges that are not used conventionally in the discharge cell 114 can contribute to the light emission. Therefore, the amount of plasma generation increases during the discharge, and the panel can be driven by a low voltage.

Figure 6:
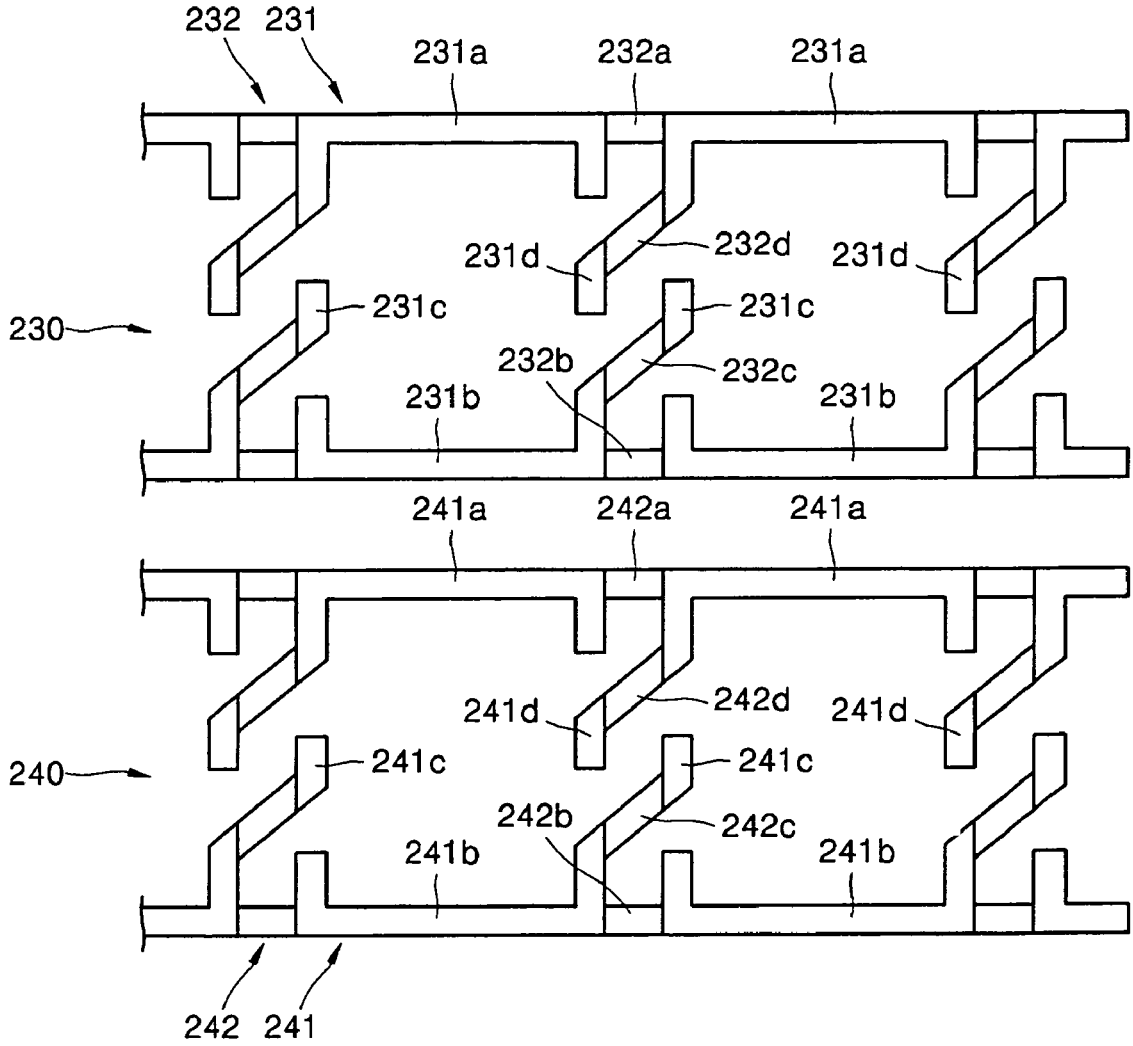
FIG. 6 is a plan view of modified examples of the upper and lower discharge electrodes of FIG. 3.

The upper and lower discharge electrodes are not limited to the above example, but can be formed in a structure shown in FIG. 6.

Referring to FIG. 6, an upper discharge electrode 230 has a different connection structure between the discharge unit 231 and the connection unit 232 than that of the above upper discharge electrode 130. That is, the upper discharge electrode 230 includes discharge units 231 that are divided into first, second, third, and fourth discharge units 231*a*, 231*b*, 231*c*, and 231*d* separated from each other, and connection units 232, first and second connections units 232*a* and 232*b* are parallel to the discharge units, and third and fourth connection units 232*c* and 232*d* are inclined predetermined angles with respect to the arrangement direction of the discharge units 231. In addition, connecting portions between the third connection unit 232*c* and the second and third discharge units 231*b* and 231*c* and connecting portions between the fourth connection unit 232*d* and the first and fourth discharge units 231*a* and 231*d* are inclined so as to correspond to the inclined angles of the third and fourth connection units 232*c* and 232*d*.

Like the upper discharge electrode 230, a lower discharge electrode 240 includes discharge units 241 that are divided into first, second, third, and fourth discharge units 241*a*, 241*b*, 241*c*, and 241*d* separated from each other, and connection units 242, first and second connections units 242*a* and 242*b* are parallel to the discharge units, and third and fourth connection units 242*c* and 242*d* are inclined predetermined angles with respect to the arrangement direction of the discharge units 241. In addition, connecting portions between the third connection unit 242*c* and the second and third discharge units 241*b* and 241*c* and connecting portions between the fourth connection unit 242*d* and the first and fourth discharge units 241*a* and 241*d* are inclined so as to correspond to the inclined angles of the third and fourth connection units 242*c* and 242*d*.

As described above, the upper and lower discharge electrodes can be modified variously within the scope of the present invention.

The PDP of the present invention has following advantages.

Since the discharge units arranged at the discharge cells to contribute to the discharge are respectively divided into plural pieces, which are separated by predetermined gaps from each other, the electric current does not flow through the gaps in the discharge units. Accordingly, the panel can be driven by a low electric current.

The electrodes and dielectric layer are not arranged in the area of the first substrate through which the visible light emitted by the discharge cell is transmitted. Thus, an aperture ratio of the substrate increases and the light transmittance rate can be improved. In addition, since the discharge occurs at every side portion of the discharge cell, the discharge area can be expanded greatly, and the panel can be driven by a low voltage.

In addition, since the phosphor layer arranged at the lower portion of the discharge cell is greatly separated from the discharge area where the sustain discharge occurs, the ion-sputtering of the fluorescent material due to the charged particles can be prevented, thus improving the life span of the panel.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A Plasma Display Panel (PDP) comprising:

a first substrate;

a second substrate facing the first substrate;

first barrier ribs, formed of a dielectric material and arranged between the first and second substrates, the first barrier ribs defining discharge cells with the first and second substrates;

a phosphor layer arranged in the discharge cells;

upper discharge electrodes arranged in the first barrier ribs and extending to surround the discharge cells; and lower discharge electrodes arranged in the first barrier ribs to be separated from the upper discharge electrodes, and extending to surround the discharge cells;

wherein at least one of the upper and lower discharge electrodes includes discharge units that are respectively divided into plural pieces separated from each other to surround the discharge cells, and connection units electrically connecting the discharge units that respectively surround the neighboring discharge cells.

2. The PDP of claim 1, wherein the discharge units are arranged in a row, and each of the discharge units includes first and second discharge units facing each other and separated from each other, and arranged along the discharge units, and third and fourth discharge units arranged between the first and second discharge units to be separated from them.

3. The PDP of claim 2, wherein the first and second discharge units are continuously connected to the first and second discharge units of an adjacent discharge cell via first and second connection units; wherein the third discharge unit is continuously connected to the second discharge unit of an adjacent discharge cell via a third connection unit; and wherein the fourth discharge unit is continuously connected to the first discharge unit of an adjacent discharge cell via a fourth connection unit.

4. The PDP of claim 3, wherein the first barrier ribs define discharge cells of a closed type, and the first and second discharge units respectively have bent end portions that exceed ¼ point of a boundary of the discharge cell and surround the discharge cell.

5. The PDP of claim 4, wherein the third and fourth connection units are arranged parallel to the direction of the discharge units.

6. The PDP of claim 4, wherein the third and fourth connection units are inclined a predetermined angle with respect to the direction of the discharge units.

7. The PDP of claim 1, wherein the upper discharge electrodes extend perpendicularly to the extending direction of the upper discharge electrodes.

8. The PDP of claim 1, wherein the upper and lower discharge electrodes extend parallel to each other, and wherein address electrodes that extend perpendicularly to the extending direction of the upper and lower discharge electrodes are arranged in the discharge cells.

9. The PDP of claim 8, wherein the address electrodes are arranged in a dielectric layer arranged between the second substrate and the phosphor layer.

10. The PDP of claim 1, wherein second barrier ribs are further arranged between the first barrier ribs and the second substrate to define discharge cells with the first barrier ribs, and wherein the phosphor layer is arranged in the spaces defined by the second barrier ribs.

11. The PDP of claim 1, wherein an MgO layer covers side surfaces of the first barrier ribs.

* * * * *